US008435126B2

(12) United States Patent
Davis

(10) Patent No.: US 8,435,126 B2
(45) Date of Patent: May 7, 2013

(54) CHANNEL MEMBER, MODULAR FLOOR, AND METHOD OF POSITIONING AN OBJECT

(75) Inventor: Adam Davis, Leola, PA (US)

(73) Assignee: Tait Towers, Inc., Lititz, PA (US)

( * ) Notice: Subject to any disclaimer, the term of this patent is extended or adjusted under 35 U.S.C. 154(b) by 295 days.

(21) Appl. No.: 13/008,376

(22) Filed: Jan. 18, 2011

(65) Prior Publication Data

US 2012/0184385 A1 Jul. 19, 2012

(51) Int. Cl.
*A63J 1/02* (2006.01)
*A63J 1/00* (2006.01)

(52) U.S. Cl.
USPC ..... 472/77; 472/79

(58) Field of Classification Search ..... 472/75–77, 472/78, 80, 81, 92, 136; 52/9–10; 254/387
See application file for complete search history.

(56) References Cited

U.S. PATENT DOCUMENTS

| | | | | |
|---|---|---|---|---|
| 455,288 | A * | 6/1891 | Knell | 472/76 |
| 490,486 | A * | 1/1893 | MacKaye | 472/77 |
| 4,650,180 | A * | 3/1987 | Blondel | 472/92 |
| 5,319,895 | A * | 6/1994 | Ray | 52/6 |
| 6,547,670 | B1 | 4/2003 | Kempf | |

FOREIGN PATENT DOCUMENTS

WO 03101574 A1 11/2003

* cited by examiner

*Primary Examiner* — Kien Nguyen
(74) *Attorney, Agent, or Firm* — McNees Wallace & Nurick LLC

(57) ABSTRACT

A channel member, a modular floor structure, and a method capable of positioning an object on a substantially planar surface is disclosed. Movement of a movable band within an interior channel of the channel member permits movement of an object outside of the interior channel.

18 Claims, 8 Drawing Sheets

FIG. 1
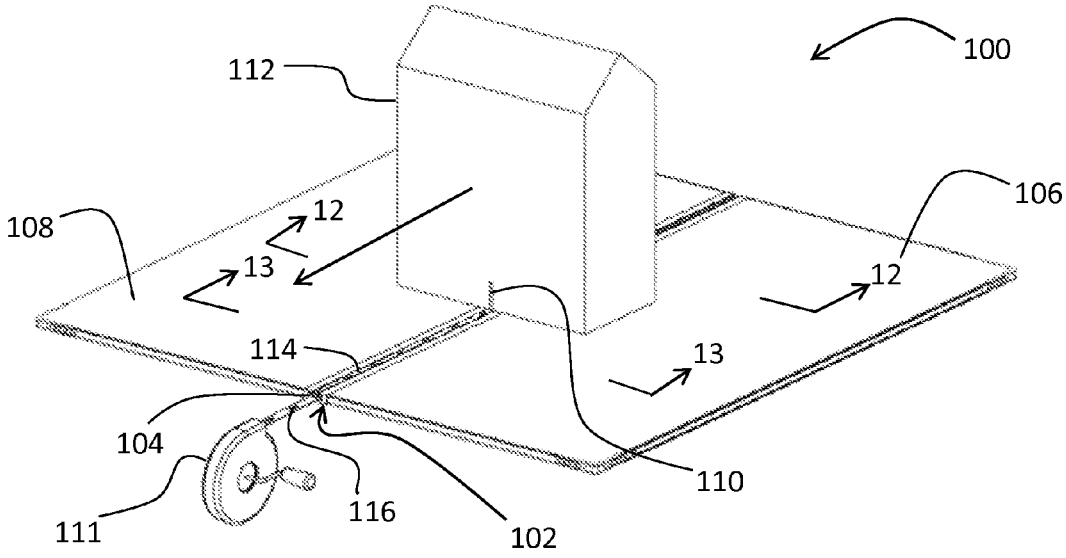
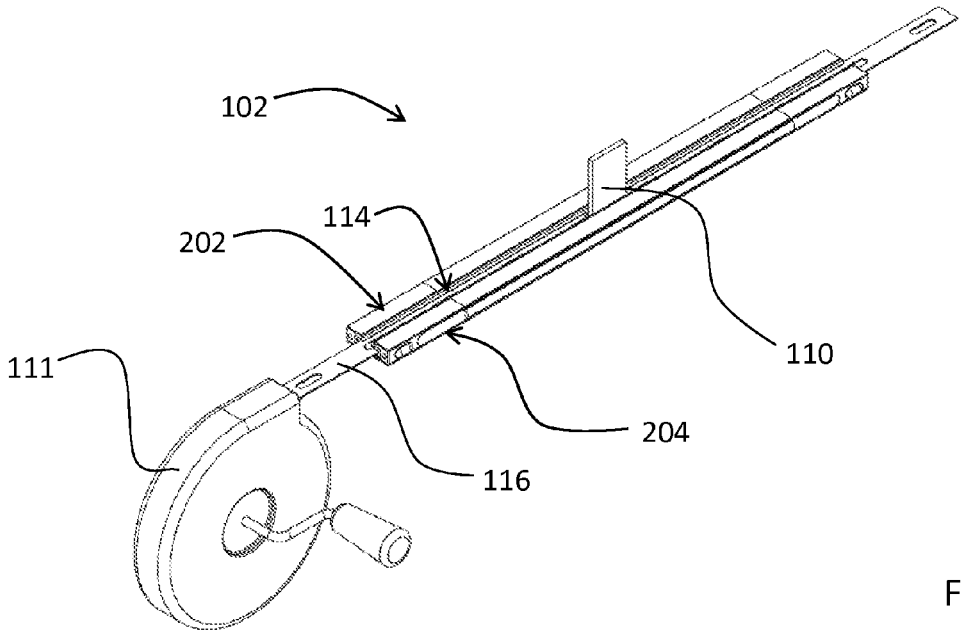
FIG. 2

FIG. 3
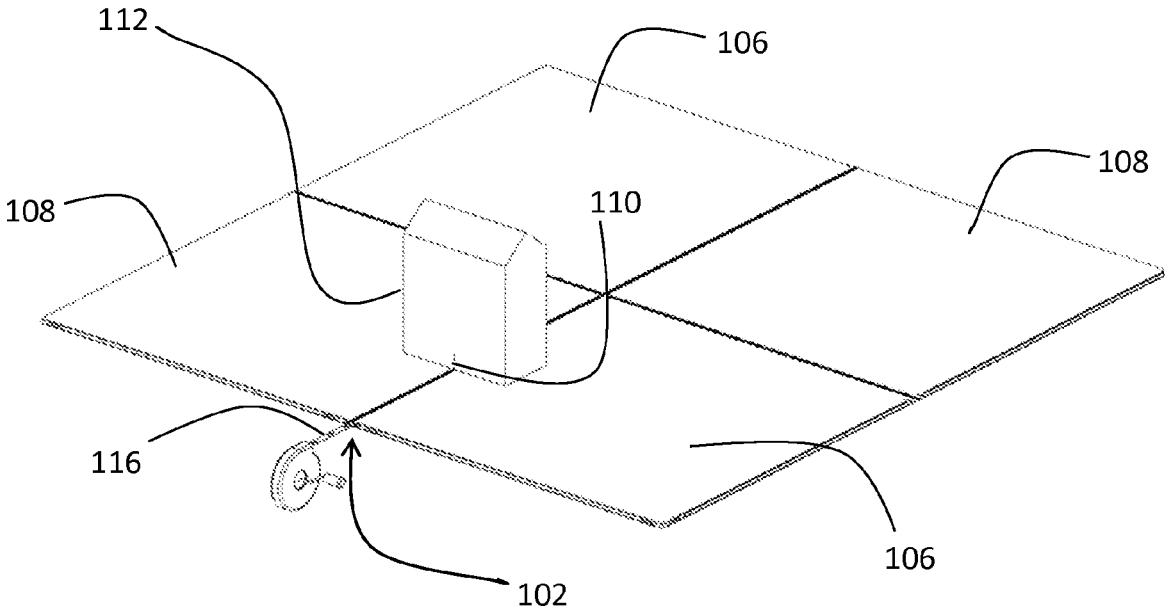
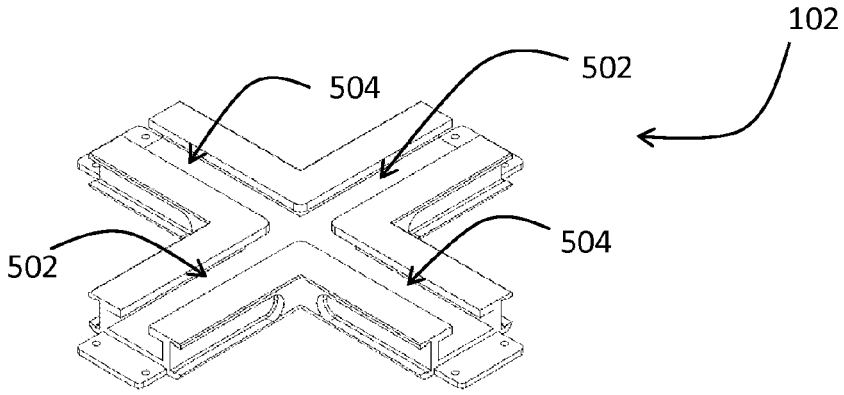
FIG. 5

FIG. 7
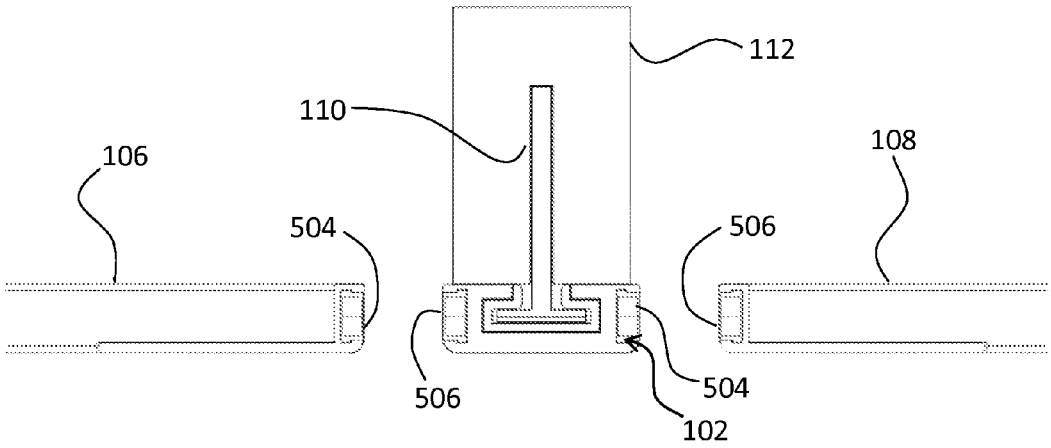
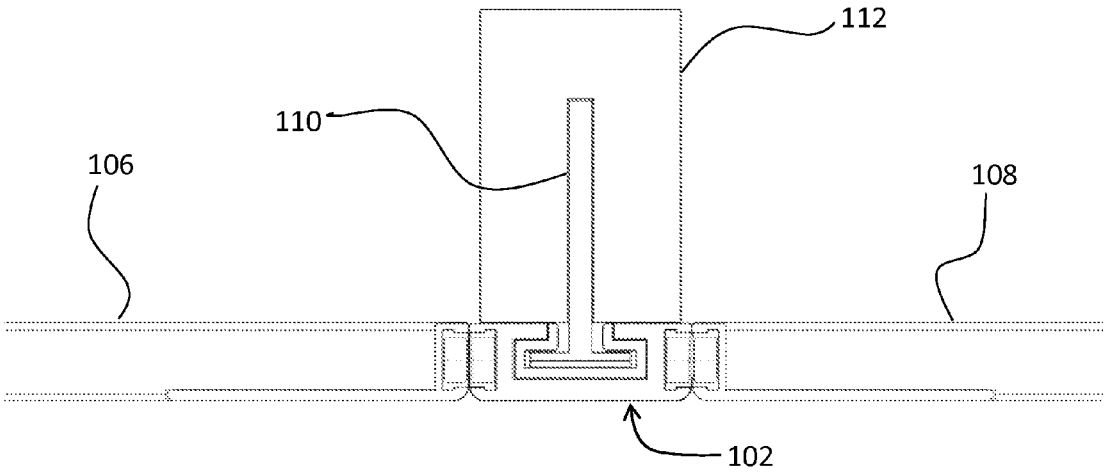
FIG. 8

FIG. 9
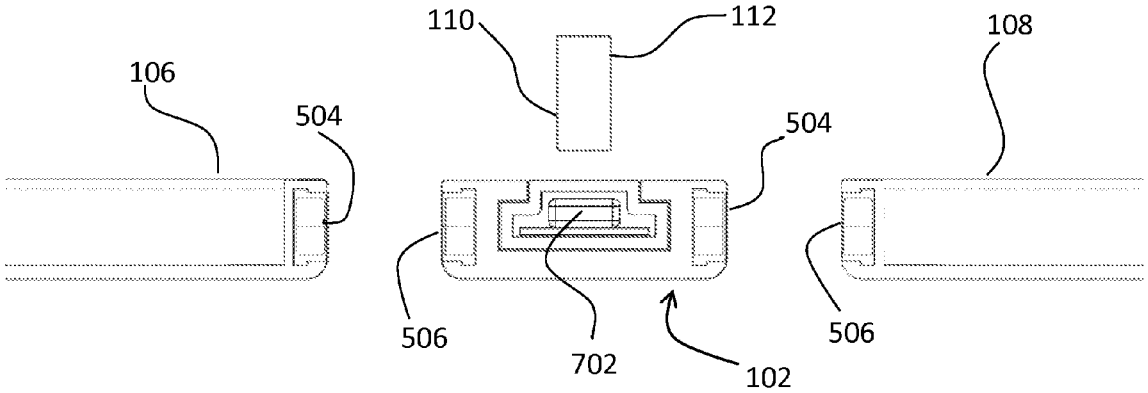
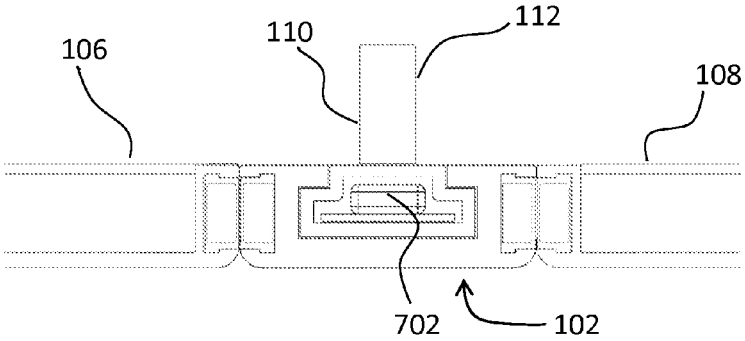
FIG. 10

FIG. 11
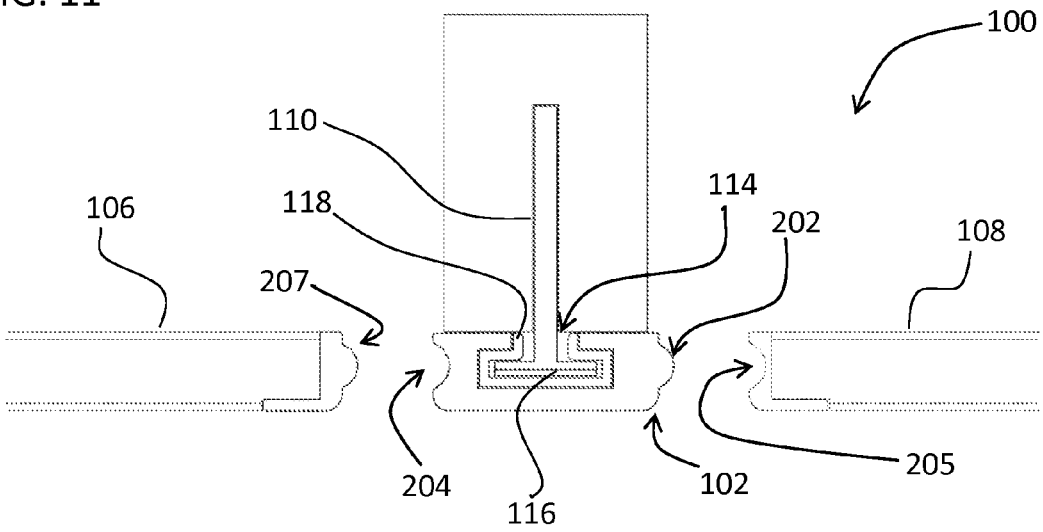
FIG. 12
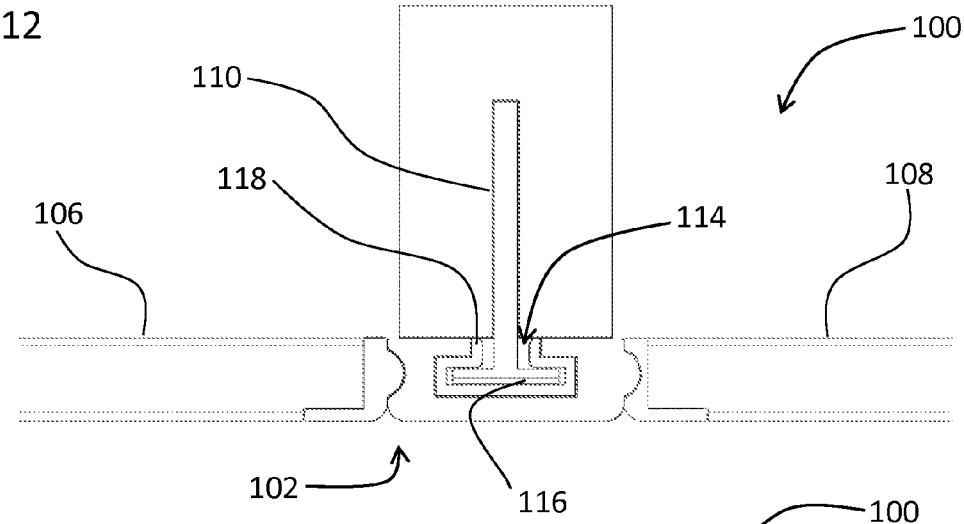
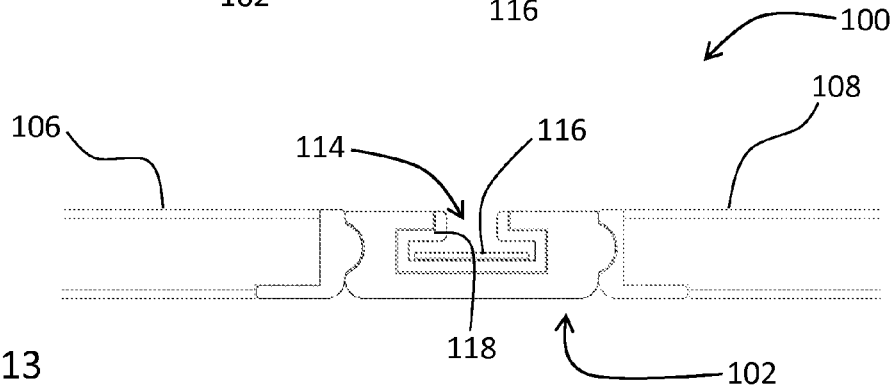
FIG. 13

CHANNEL MEMBER, MODULAR FLOOR, AND METHOD OF POSITIONING AN OBJECT

FIELD OF THE INVENTION

The present invention is directed to stages, platforms, and theatrical sets. More specifically, the present invention is direct to a channel member, modular floor, and method capable of positioning an object on a stage, platform, theatrical set, or other suitable surface.

BACKGROUND OF THE INVENTION

In theatrical presentation, positionable objects are moved on and off stage to change scenes, show movement in a scene, and/or for other aesthetic purposes. For example, a specific scene may include several positionable objects forming the set. Each of the positionable objects may be moved on and off of the stage according to various known systems and methods.

In one known method, positionable objects have wheels and/or low friction surfaces. The positionable objects are rolled and/or slid on and off the stage to change scenes by individuals referred to as stage hands. This method suffers from the drawbacks that the positioning of the positionable objects can be inconsistent, the stage hands may be seen (resulting in undesirable aesthetics), and/or the movement of the objects can be difficult to control.

In another known method, positionable objects include features permitting the positionable objects to be lifted by cables extending from the ceiling. This method suffers from the drawbacks that the lifting of the object can require a substantial amount of force, wind can cause the positionable objects to sway (which can even cause the positionable objects to hit each other), and the positionable objects can be difficult to modify or fix during a show because they are not easily accessed.

What is needed is an article, system, and process capable of positioning an object on a surface (such as a stage) that do not suffer from the drawbacks of the prior art.

SUMMARY OF THE INVENTION

In an exemplary embodiment, a channel member includes a first interior channel extending along the channel member, a first feature extending along the channel member and configured to engage a first floor member, a second feature extending along the channel member and configured to engage a second floor member, and a movable band disposed within the first interior channel. Movement of the movable band permits movement of an object outside of the first interior channel, and the channel member is configured to mate a second channel member having a second interior channel thereby aligning the first interior channel and the second interior channel.

In another exemplary embodiment, a modular floor structure includes a first floor member having a first channel member disposed therein, a second floor member having a second channel member disposed therein, and a movable band disposed within an interior channel. The first channel member and the second channel member align upon mating of the first floor member and the second floor member to form the interior channel, and movement of the moveable band in the interior channel permits movement of an object positioned on the first floor member.

In another exemplary embodiment, a method of positioning an object on a first floor member of a modular floor structure includes adjusting the relative position of an object by adjusting a movable band in a modular floor structure. The modular floor structure includes the first floor member having a first channel member disposed therein, a second floor member having a second channel member disposed therein, and the movable band disposed within an interior channel. The first channel member and the second channel member align upon mating of the first floor member and the second floor member to form the interior channel and movement of the moveable band in the interior channel permits movement of the object positioned on the first floor member.

One advantage of an embodiment of the disclosure includes permitting concealed movement of objects on a stage.

Another advantage of an embodiment of the disclosure includes being able to form a portable platform structure that is easily assembled and disassembled.

Another advantage of an embodiment of the disclosure includes being able to coordinate movements of objects on a stage according to a predetermined program.

Another advantage of an embodiment of the disclosure includes being able to form a low profile stage permitting a single layer platform because carts and trucks previously used under stages for positioning can be eliminated.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

FIG. 1 shows an exemplary modular floor having a first floor member and a second floor member with a channel member positioned between according to the disclosure.

FIG. 2 shows an exemplary channel member according to the disclosure.

FIG. 3 shows an exemplary modular floor having a channel member in a unitary floor member according to the disclosure.

FIG. 5 shows a perspective view of an exemplary channel member according to the disclosure.

FIG. 7 shows a sectioned view at a positioning feature of an exemplary modular floor with a channel member positioned between but not engaged to a first floor member and a second floor member according to the disclosure.

FIG. 8 shows a sectioned view at a positioning feature of an exemplary modular floor with a channel member positioned between and magnetically engaged to a first floor member and a second floor member according to the disclosure.

FIG. 9 shows a sectioned view at a positioning feature of an exemplary modular floor with a channel member positioned between but not engaged to a first floor member and a second floor member according to the disclosure.

FIG. 10 shows a sectioned view at a positioning feature of an exemplary modular floor with a channel member positioned between and magnetically engaged to a first floor member and a second floor member according to the disclosure.

FIG. 11 shows a sectioned view at a positioning feature of an exemplary modular floor with a channel member positioned between but not engaged to a first floor member and a second floor member according to the disclosure.

FIG. 12 shows a sectioned view of FIG. 1 along line 12-12.

FIG. 13 shows a sectioned view of FIG. 1 along line 13-13.

DETAILED DESCRIPTION OF THE INVENTION

Figure 4:
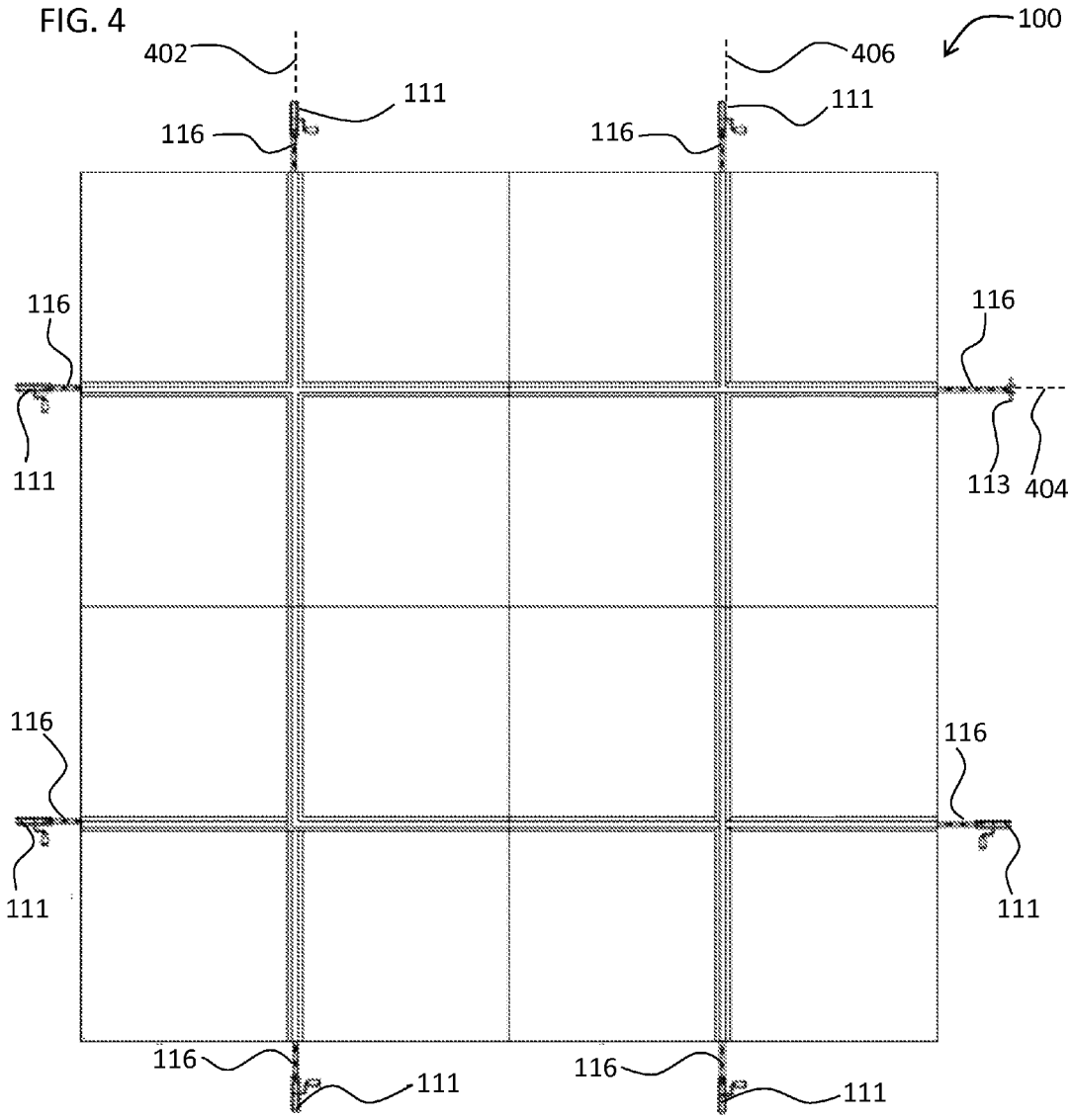
FIG. 4 shows an exemplary modular floor having a plurality of floor members and a plurality of channel members according to the disclosure.

Provided is an article, system, and process capable of positioning an object on a surface (such as a stage) that do not suffer from the drawbacks of the prior art. Embodiments of the disclosure permit positioning and repositioning of objects on a stage without using stage hands on the stage, permit concealed movement of objects on a stage, permit coordinated movements of objects on a stage according to a predetermined program, permit broader use of lower profile stages, permit a reduction or elimination of using caster wheels for positioning and repositioning objects on a stage, and combinations thereof.

FIG. 1 shows an exemplary channel member 102 in a modular floor 100 permitting concealed movement of an object 112 according to an embodiment of the disclosure. As used herein, the term "concealed movement" refers to movement executed by a source that is not easily viewed by an audience during a presentation. For example, concealed movement includes movement along a hidden track or movement by concealed bands/cables. The channel member 102 includes an interior channel 104 extending along the channel member 102. In one embodiment, the width of the interior channel 104 is larger than the height of the interior channel 104.

Referring to FIGS. 1 and 2, the channel member 102 includes a first feature 202 (see FIG. 2) extending along the channel member 102 and configured to engage a corresponding feature on a first floor member 106. Additionally or alternatively, the channel member 102 includes a second feature 204 (see FIG. 2) extending along the channel member 102 and configured to engage a corresponding feature on a second floor member 108. The first floor member 106 and/or the second floor member 108 can include any suitable features. For example, one or both can include patterns, coatings, tongue and groove features, high friction/low friction surfaces, anti-static properties, electrically conductive properties, composite compositions, wood compositions, metal compositions, insulation, shock absorption, ultra-lightweight honeycomb, inner cells encased, cross-grained multi-ply skins, a predetermined crush resistance (for example, between 50 PSI and 200 PSI), or any other suitable properties.

The channel member 102 permits movement of the object 112 along the channel member 102 by repositioning a positioning feature 110 at least partially disposed within the interior channel 104. A positioning mechanism 111 deploys or retracts a band 116 facilitating movement thereof. The positioning feature 110 is fastened, affixed, adhered, or otherwise identifiable with the band 116 that slidably fits within the interior channel 104. In one embodiment, the band 116 is a composite material (for example, including a blend of alloys, ceramics, polymers, or other suitable materials), a metal material (for example, an elemental metal, an alloy, or a composite metal), combinations thereof, or any other suitable material. In one embodiment, the channel member 102 is a polymeric material (for example, including polyester, vinyl ester, epoxy, phenolic, polyimide, polyamide, polypropylene, polyether ether ketone), a self lubricating material (for example, carbon-graphite materials, silver-impregnated carbon-graphite materials, carbon-containing metal alloys, boron nitride in a silicon nitride ceramic, boron nitride in alumina nitride ceramic, boron nitride in titanium nitride ceramic, and combinations thereof), combinations thereof, or any other suitable material. In one embodiment, an interior surface of the channel member 102 abutting the band 116 is a polymeric material, a self-lubricating material, other suitable materials, or combinations thereof. As the band 116 slides along the interior channel 104, the positioning feature 110 slides along the interior channel 104. When the positioning feature 110 slides along the interior channel 104, the object 112 is repositioned along a predetermined path defined by one or more channel members 102. In one embodiment, the band 116 includes chain links (not shown). In a further embodiment, the positioning mechanism 111 extends or retracts some of the chain links by engaging the chain links with a gear (not shown) or sprocket (not shown) included within the positioning mechanism 111.

FIG. 3 shows an exemplary channel member 102 in the first floor member 106 and the second floor member 108 according to an embodiment of the disclosure. The first floor member 106 and the second floor member 108 mate to form a substantially planar surface with the channel 104 extending from the first floor member 106 into and/or through the second floor member 108. Stated another way, the first floor member 106 and the second floor member 108 form a unitary channel member 102 extending within the first floor member 106 and the second floor member 108. The mating of the first floor member 106 and the second floor member 108 includes any suitable alignment features. For example, in one embodiment, the first floor member 106 and the second floor member 108 are aligned by alignment features (for example, geometric attributes), magnets, fasteners, latches, any other suitable mating features, or combinations thereof. In one embodiment, the band 116 slides along the interior channel 104 in the first floor member 106 and the second floor member 108, thereby sliding the positioning feature 110 along the interior channel 104. When the positioning feature 110 slides along the interior channel 104, the object 112 is repositioned along a predetermined path defined by the first floor member 106 and the second floor member 108.

In one embodiment, the first floor member 106 and/or the second floor member 108 includes more than one interior channel 104 and/or intersecting interior channels 104. Additionally or alternatively, the first floor member 106 and/or the second floor member 108 can include any other suitable features for positioning the object 112. For example, the first floor member 106 and/or the second floor member 108 can include any suitable features described below with reference to the modular floor 100.

FIG. 4 shows an exemplary embodiment of the modular floor 100. The modular floor 100 includes any suitable number of channel members 102 for positioning the object 112 (see FIGS. 1 and 3). The channel members 102 can be aligned consecutively, can intersect at a 90 degree angle, can intersect at an angle other than 90 degrees, can be configured for a plurality of the bands 116, can extend throughout the modular floor 100, can be configured for the bands 116 to turn or rotate, can extend through a portion of the modular floor 100, or any suitable combination thereof. In one embodiment, the modular floor 100 includes channel members 102 arranged for the band 116 to position the object 112 (see FIGS. 1 and 3) along a first axis 402. In a further embodiment, the modular floor 100 includes channel members 102 arranged for the band 116 to position the object 112 along a second axis 404 too. In yet a further embodiment, the modular floor 100 includes channel members arranged for the band 116 to position the object 112 along a third axis 406 too.

In contrast to the embodiment shown in FIG. 3, referring to FIG. 5, in one embodiment with the channel member 102 being a separate component from the first floor member 106 and the second floor member 108, the channel member 102 includes a first channel 502 and a second channel 504 for a first band (not shown) and a second band (not shown). In this embodiment, the first band and the second band intersect with one above the other at the point of intersection. In further embodiments, studs, pins, pulleys, tracks, dividers, or other suitable alignment mechanisms are used for relatively positioning two or more than two bands within the channel member 102.

Figure 6:
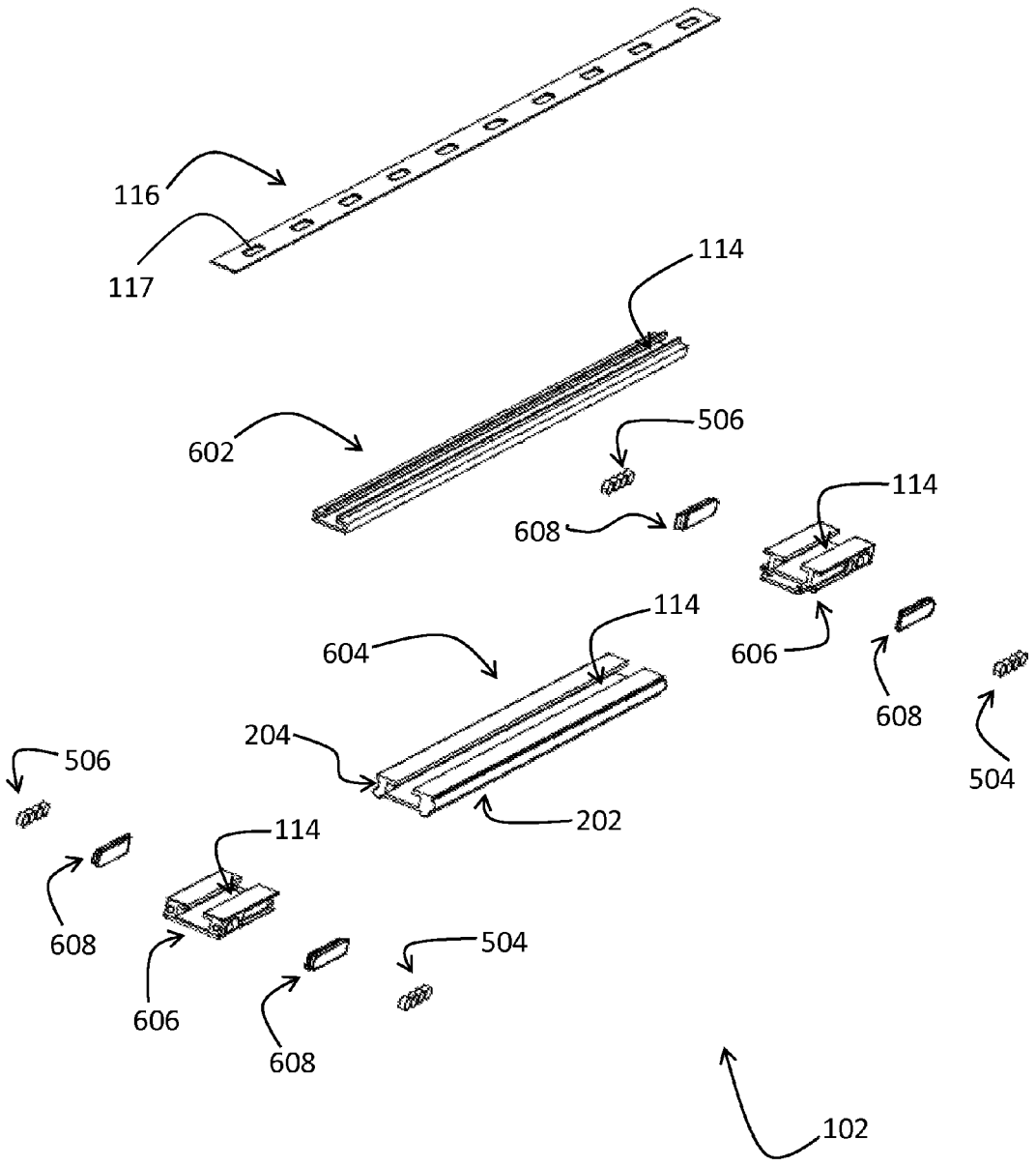
FIG. 6 shows an exploded perspective view of an exemplary channel member according to the disclosure.

Referring to FIG. 6, in one embodiment, the channel member 102 includes several modular components for facilitating simple and repeatable assembly. FIG. 6 shows an exploded perspective view of the channel member 102. In this embodiment, the band 116 slidably fits within a channel member insert 602. The channel member insert 602 extends throughout the interior of a channel member joint 604 and one or more interlocking channel member components 606. The insert 602 facilitates movement of the band 116 by, for example, including a self-lubricating material and by being easily removable for repair or replacement. In one embodiment, the insert 602 is a flexible material permitting full and easy lubrication. The insert 602 is positioned within the channel member joint 604 and the interlocking channel member components 606 are inserted on opposing ends of the channel member joint 604. The channel member joint engages features on the first floor member 106 (see FIG. 1) and the second floor member 108 (see FIG. 1) but does not secure the channel member 102 to the first floor member 106 and the second floor member 108. The interlocking channel member components 606 include magnets 504, 506 (described below) positioned within a magnet housing 608 secured to the interlocking channel member components 606 (for example, by fasteners, adhesive, welding, soldering, or other suitable securing).

Referring to FIGS. 7-10, in one embodiment, the first floor member 106 and/or the second floor member 108 include a magnet 504 arranged and disposed to engage a magnetically attractive feature 506 (for example, a ferro-magnetic material or a corresponding attractive magnet) on the channel member 102 and/or through the channel member 102 to the opposing floor member. In one embodiment, the magnet 504 and/or the magnetically attractive self-lock and/or align the first floor member 106, the channel member 102, and the second floor member 108 by having only one compatible position. In one embodiment, a plurality of the magnets 504 and a plurality of the magnetically attractive features 506 provide a predetermined force per channel member 102 (for example, between about 100 and about 600 pounds). In one embodiment, the magnets 504 and/or the magnetically attractive features 506 are neodymium permanent magnets. To the contrary, referring to FIGS. 11-13, in one embodiment, the first floor member 106 and/or the second floor member 108 are devoid of a magnet and the first floor member 106 and the second floor member 108 each engage the channel member 102 by a friction fit, fasteners, or any other suitable securing mechanism.

Referring to FIG. 11, in one embodiment, the channel member 102 includes the first feature 202 being an exterior tongue section and the second feature 204 being an exterior groove section. The tongue section is arranged and disposed to engage a groove 205 on the first floor member 106 and the groove section is arranged and disposed to engage a tongue 207 on the second floor member 108. Upon being engaged, the first floor member 106, the second floor member 108, and the channel member 102 define the modular floor 100. The channel member 102 can be use with any suitable portable substantially planar surface. For example, in other embodiments, the channel member 102 is used with portable walls, ceilings, scaffolding, fences, decks, roads, bridges, supports, roofs, platforms, air craft carriers, parking structures, or any suitable substantially planar surface.

Referring specifically to FIGS. 7-8, in one embodiment, the object 112 is secured to the positioning feature 110 that extends from within the channel member 102 and is moveable along at least a portion of the interior channel 104. Referring to FIGS. 9-10, in one embodiment, the object 112 is secured to the positioning feature 110 and positioned by a magnet 702 on the band 116 movable within the channel member 102. In a further embodiment, the object 112 includes a magnetically attractive material permitting movement of the magnet 702 to move the object 112.

FIG. 11 shows a sectioned view of an embodiment of the channel member 102 where the positioning feature 110 is secured to the band 116. In FIG. 11, the channel member 102 is positioned between the first floor member 106 and the second floor member 108. FIG. 12 shows a sectioned view of FIG. 1 along 12-12 where the positioning feature 110 is secured to the band 116. FIG. 13 shows a sectioned view of FIG. 1 along 13-13 where the positioning feature 110 is not secured to the band 116. In FIGS. 12 and 13, the channel member 102 is positioned between and engaged to the first floor member 106 and the second floor member 108 to form the modular floor 100.

Referring to FIGS. 11-13, in one embodiment, the channel member 102 includes a slot 114 extending along the channel member 102. The slot 114 is at least partially exposed to an area outside of the channel member 102 (for example, on a surface of a stage). The slot 114 is sized to be smaller than the band 116 positioned within the interior channel 104 and/or the interior channel 104. The slot 114 includes a retention feature 118 (for example, a protrusion above a portion of the interior channel 104). Such sizing prevents the band 116 from dislodging from the interior channel 104. The slot 114 is further sized to permit the positioning feature 110 to extend from the band 116 to the object 112. In one embodiment, the slot 114 includes a width that is barely wider than a width of the positioning feature 110. In this embodiment, interior side walls of the slot 114 provide support to the positioning feature 110. By repositioning the object 112 with movement of the band 116, the object 112 can be positioned and repositioned on the portable floor 100 formed by the first floor member 106, the second floor member 108, and any additional floor members.

Referring to FIG. 3, positioning of the object 112 is achieved by retraction, extension, and/or rotation of the band 116 by the positioning mechanism 111. In one embodiment, the positioning mechanism 111 is a manual device that rotatably retracts or extends the band 116. In another embodiment, the positioning mechanism 111 is an automated device, such as an automated winch, that rotates according to a predetermined program. In one embodiment, the positioning mechanism 111 is driven by a motor. For example, in one embodiment, the positioning mechanism 111 includes a servo drive capable of receiving a command signal from a control system, amplifying the signal, and transmitting current to a servo motor to generate a predetermined amount of movement. In one embodiment, the command signal includes operational parameters including, but not limited to, velocity, acceleration, position, torque, power, voltage frequency, proportional gain, derivative gain, feedback gain, or other suitable parameters that are adjustable.

In one embodiment, the positioning mechanism 111 is positioned opposite a second positioning mechanism 111 on an opposite side of the channel member 102. In this embodiment, the first positioning mechanism 111 and the second positioning mechanism 111 operate together to position the object 112. In one embodiment, the positioning mechanism 111 is positioned opposite a rotatable device 113 (for example, a pulley or wheel). In one embodiment, multiple positioning mechanisms 111, multiple channel members 102, and multiple bands 116 adjust multiple objects 112 at the same time. Additionally or alternatively, in one embodiment, the band(s) 116 are used for actuation of mechanisms. For example, in this embodiment, the band(s) 116 can activate spring-activated and/or magnetically-activated mechanisms, thereby permitting concealed activation (for example, in a magic presentation).

Figure 14:
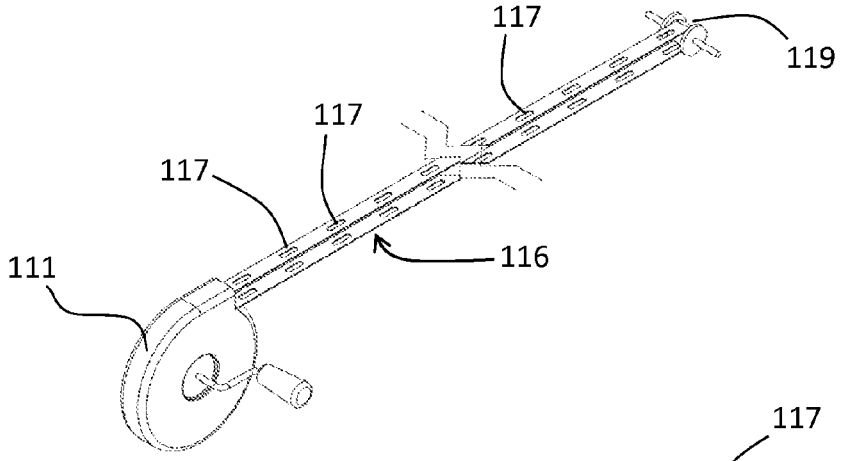
FIGS. 14-16 show exemplary band arrangements according to the disclosure.
Figure 15:
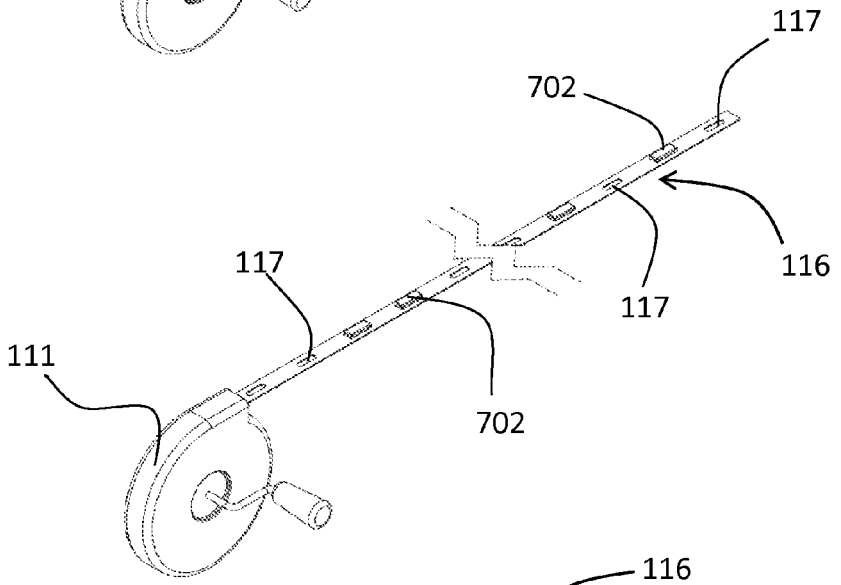
Figure 16:
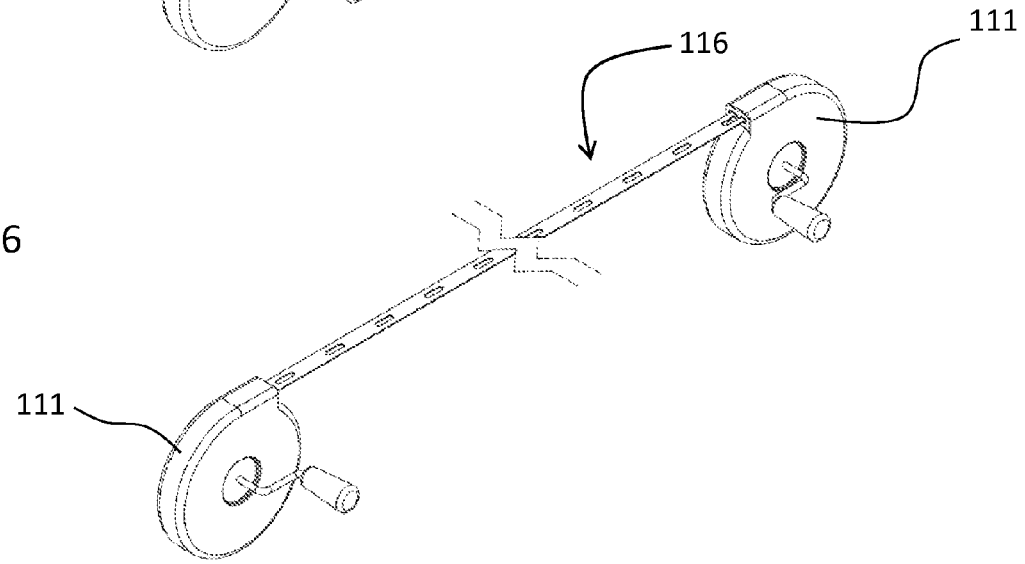

Referring to FIGS. 14-16, in one embodiment, the band 116 is a substantially planar elongate structure having one or more apertures 117 to permit the positioning feature 110 (not shown) to be secured at one or more positions along the band 116. As shown in FIG. 14, in one embodiment, the band 116 is positioned around a stud 119 or pulley permitting a single positioning mechanism 111 to retract or extend the band 116 and/or permitting the band 116 to extend through a portion or all the way through the modular floor 100. As shown in FIG. 15, in one embodiment, the band 116 includes the magnet 702 for positioning the object 112 (not shown). As shown in FIG. 16, in one embodiment, the band 116 is positioned between a first positioning mechanism 11 and a second positioning mechanism 111 permitting the band 116 to be retracted or extended.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A channel member, comprising:
- a first interior channel extending along the channel member;
- a first feature extending along the channel member and configured to engage a first floor member;
- a second feature extending along the channel member and configured to engage a second floor member; and
- a movable band disposed within the first interior channel;
- wherein movement of the movable band permits movement of an object outside of the first interior channel; and
- wherein the channel member is configured to mate a second channel member having a second interior channel thereby aligning the first interior channel and the second interior channel and wherein the channel member includes a slot extending along the channel member.

2. The channel member of claim 1, wherein the slot is at least partially exposed to an area outside of the channel member.

3. The channel member of claim 2, wherein the band comprises a magnet.

4. The channel member of claim 1, wherein the object is secured to a positioning feature on the moveable band.

5. The channel member of claim 1, further comprising:
- a slot extending along the channel member;
- wherein the slot is at least partially exposed to an area outside of the channel member;
- wherein the slot includes a retention feature for preventing the band from exiting the channel member through the slot.

6. The channel member of claim 1, wherein the first interior channel comprises a self lubricating material.

7. The channel member of claim 1, wherein the first interior channel comprises a polymeric material.

8. A modular floor structure, comprising:
- a first floor member having a first channel member disposed therein;
- a second floor member having a second channel member disposed therein;
- a movable band disposed within an interior channel;
- wherein the first channel member and the second channel member align upon mating of the first floor member and the second floor member to form the interior channel and the first channel member and second channel member include a slot extending along the first channel member and the second channel member; and
- wherein movement of the moveable band in the interior channel permits movement of an object positioned on the first floor member.

9. The modular floor of claim 8, wherein movement the object positioned on the first floor member repositions the object.

10. The modular floor of claim 8, wherein movement the object positioned on the first floor member actuates an actuating mechanism.

11. The modular floor of claim 8, further comprising:
- a slot extending along the interior channel;
- wherein the slot is at least partially exposed trough the first floor member;
- wherein the slot includes a retention feature for preventing the movable band from exiting the interior channel through the slot.

12. The modular floor of claim 8, wherein the movable band is configured to position the object along at least a first axis and a second axis.

13. The modular floor of claim 8, further comprising a positioning mechanism for adjusting the relative position of a positioning feature by retracting or extending the movable band.

14. The modular floor of claim 13, further comprising a rotatable device, wherein the movable band extends from the positioning mechanism to the rotatable device and then back to the positioning mechanism.

15. The modular floor of claim 13, wherein the positioning feature includes a fastener engageable to the moveable band.

16. The modular floor of claim 13, wherein the positioning feature includes a magnet affixed the moveable band and the object includes a magnetically attractive material permitting movement of the magnet to move the object.

17. The modular floor of claim 8, wherein the first floor member and the second floor member are configured to align in a single position.

18. A method of positioning an object on a first floor member of a modular floor structure, the method comprising:
- providing the modular floor structure, the modular floor structure comprising:
  - the first floor member having a first channel member disposed therein;

a second floor member having a second channel member disposed therein;

a movable band disposed within an interior channel;

wherein the first channel member and the second channel member align upon mating of the first floor member and the second floor member to form the interior channel and the first channel member and second channel member include a slot extending along the first channel member and the second channel member; and wherein movement of the moveable band in the interior channel permits movement of the object positioned on the first floor member;

adjusting the relative position of the object by adjusting the movable band.

* * * * *